US006027581A

United States Patent [19]

Osawa et al.

[11] Patent Number: 6,027,581

[45] Date of Patent: Feb. 22, 2000

[54] COLD ROLLED STEEL SHEET AND METHOD OF MAKING

[75] Inventors: Kazunori Osawa; Masahiko Morita, both of Okayama; Osamu Furukimi; Takashi Obara, both of Chiba, all of Japan

[73] Assignee: Kawasaki Steel Corporation, Japan

[21] Appl. No.: 08/935,600

[22] Filed: Sep. 23, 1997

[30] Foreign Application Priority Data

Feb. 10, 1996 [JP] Japan ..... 9-026840

[51] Int. Cl.[7] ..... C22C 38/14; C21D 8/04

[52] U.S. Cl. ..... 148/330; 148/541; 148/603; 148/547; 148/623; 148/624

[58] Field of Search ..... 148/541, 547, 148/603, 330, 623, 624

[56] References Cited

U.S. PATENT DOCUMENTS 4,790,885 12/1988 Imagumbai et al. ..... 148/547
5,123,969 6/1992 Chou .

FOREIGN PATENT DOCUMENTS 60-258429 12/1985 Japan .
267220 11/1990 Japan ..... 148/541
5-279789 10/1993 Japan .
5-186824 11/1993 Japan .

*Primary Examiner*—Deborah Yee
*Attorney, Agent, or Firm*—Austin R. Miller

[57] ABSTRACT

Cold rolled steel sheet with excellent deep drawability and excellent anti-aging properties, and manufacturing method. The cold rolled steel sheet comprises about C: above 0.015 to 0.150 wt %, Si: 1.0 wt % or less, Mn: 0.01 to 1.50 wt %, P: 0.10 wt % or less, S: 0.003 to 0.050 wt %, Al: 0.001 to below 0.010 wt %, N: 0.0001 to 0.0050 wt %, Ti: 0.001 wt % or more and Ti(wt %)/[1.5×S(wt %)+3.4×N(wt %)]≦about 1.0 and B: about 0.0001 to 0.0050 wt %, during annealing, grain growth is improved; Ti is added to form a nitride and a sulfide to avoid precipitation of fine TiC; B is added to precipitate Boron precipitates ($Fe_2B$, Fex(C,B)y) in a cooling the hot rolled steel sheet and in cooling step during annealing after cold rolling; a spherical cementite is precipitated and grown in which the Boron series precipitate is a precipitation site.

20 Claims, 3 Drawing Sheets

COLD ROLLED STEEL SHEET AND METHOD OF MAKING

BACKGROUND OF THE INVENTION (i) Field of the Invention

The present invention relates to a cold rolled steel sheet of low carbon-aluminum killed steel, and a method of making the same, and to a hot-rolled steel strip from which it is made. More specifically, the present invention relates to a cold rolled steel sheet having good deep drawability and anti-aging properties, and its manufacturing method together with a hot rolled steel strip of which it is made.

(ii) Description of the Related Art

Since a cold rolled steel sheet has higher dimensional accuracy, finer surface appearance and more excellent workability as compared to a hot rolled steel sheet, a cold rolled steel sheet is widely used for automobiles, electric appliances, building materials and the like. Heretofore, mild cold rolled sheets having higher ductility (a total elongation:El) and Lankford value:(r-value) have been proposed as cold rolled steel sheets having good workability. These steels utilize adjustments of various compositions of steel, or a combination of compositions and manufacturing methods. A typical example is an extra low carbon steel sheet in which the amount of C in the steel is reduced to 50 ppm or less in the steel making process, and to which an element forming a carbide and a nitride (such as Ti and Nb) is added. These steel sheets are mainly manufactured by continuous annealing. Such a steel sheet can achieve excellent characteristics such as a yield strength (YS) of ≦200 Mpa, a total elongation (El) of ≧50% and an r value≧2.0. Additionally, in such an extra low carbon steel sheet, the solute carbon and the solute nitrogen, which tend to cause aging deterioration, are completely stabilized as carbide or nitride. Therefore, material deterioration is scarcely caused due to aging by solute nitrogen or by solute carbon.

However, as described above, the extra low carbon steel is produced by degassing in order to reduce the amount of C to 50 ppm or less. Thus, the production cost of the extra low carbon steel is higher than that of common low carbon killed steel: 0.02%–0.06%). Furthermore, the characteristics of the extra low carbon steel sheet other than workability are inferior to those of common low carbon killed steel, more specifically, chemical conversion treatability, welded joint strength or the like as disclosed in "TETSU-TO-HAGANE" ((1985)-S1269) edited by the Iron and Steel Institute of Japan and "Current Advance in Material and Process" (Vol. 1, (1988)-946) edited by the same. Accordingly, there are many applications for which only low carbon killed steel must be used.

However, when the low carbon killed steel is used as the source, it is not easy to manufacture a cold rolled steel sheet having good workability and anti-aging properties by continuous annealing. In general, the temperature after hot rolling is 600° C. or more, in order to fix the solute nitrogen as AlN. In continuous annealing after cold rolling, rapid cooling is performed in the cooling process, after completion of recrystallization. Then, while holding the sheet for a few minutes at a temperature of 300–500° C., cementites precipitate in the crystal grain and the grain boundaries, and this reduces the amount of solute carbon. Even in such a method, it is very difficult to manufacture a steel sheet having good anti-aging properties, in which the aging index is 40 Mpa or less. (A.I.: after a tension of 7.5%, the tensile stress difference before and after aging treatment for thirty minutes at 100° C.).

Moreover, as described above, an important factor in making a cold rolled steel sheet having excellent workability is the provision of an extra low carbon steel sheet. Accordingly, in recent continuous annealing facilities averaging treatment facilities are considered to be metallurgically unnecessary. Furthermore, due to problems such as construction cost, averaging treatment facilities are not always provided. When the low carbon content killed steel passes through the continuous annealing facilities, it has been found to be impossible to manufacture a steel sheet having an A. I. (aging index) value of not more than 40 MPa.

In order to obtain a product having good anti-aging properties by applying averaging treatment for a short time, study and development have been undertaken. In the method proposed in Japanese Patent Application Laid-open No. 57-126924/1982, after completion of hot rolling of a steel containing C and Mn within a predetermined range, the steel is coiled at 400° C. or less. The resulting cementite is finely dispersed in the hot rolled steel sheet. The very fine cementite serves as a precipitation nucleus (precipitation site) for the solute C so as to reduce the amount of solute C. Moreover, in the method proposed in Japanese Patent Application Laid-open No. 2-141534/1990, an appropriate hot rolling condition including slab heating temperature is determined for the low carbon killed steel to which a little more Al and N are added, or for a steel to which B is added. The solute N in the steel is completely fixed as AlN or BN. The AlN and BN are defined as a precipitation nucleus (precipitation site) so as to precipitate the solute C and to perform temper rolling at a high reduction ratio.

However, in the method described in Japanese Patent Application Laid-open No. 57-126924/1982, since the coiling temperature is low, the crystalline grain is fine. Therefore, increase of strength (YS) and reduction of workability (El) cannot be avoided. Furthermore, in the method described in Japanese Patent Application Laid-open No. 2-141534/1990, although a cold rolled steel sheet with good anti-aging property can be obtained, temper rolling at a high reduction ratio is essential. Accordingly, increase of YS (yield strength) and reduction of El (elongation) are also caused. In any known method, it is difficult to obtain both excellent workability (more specifically, ductility) and excellent anti-aging properties.

SUMMARY OF THE INVENTION

We have discovered a cold rolled steel sheet and method providing both excellent workability and excellent anti-aging properties when, without particular restrictions as to hot rolled steel coiling condition or reduction ratio in temper rolling after annealing, low carbon killed steel is used as a source so that heat treatment may be performed in a continuous annealing facility without the use of any averaging treatment facility.

Important features of the present invention include the following:

(1) The total Al content of the steel is less than about 0.010%. This reduces solute Al. Thus, grain growth during annealing is promoted, and this improves workability.

(2) The Ti content is limited to an amount necessary to form nitrides and sulfides. Thus, substantial precipitation of fine TiC is avoided. This promotes recrystallization and grain growth during continuous annealing, thereby allowing workability to be improved.

(3) Boron (B) is present in an amount sufficient to precipitate B-containing inclusions (for example, $Fe_2B$ and Fex(C,B)y) in cooling of the hot rolled sheet and in cooling during annealing of the cold rolled sheet. These boron-containing inclusions serve as precipitation sites for spherical cementites, which grow and significantly improve the anti-aging properties of the steel.

(4) The cementite is spheroidized in the hot rolled sheet. Thus, the formation of a (111) structure, which is useful for deep drawing during cold rolling and recrystallization annealing, is promoted in the steel of the cold rolled steel sheet.

The present invention has created a novel cold rolled steel sheet having excellent deep drawability and excellent anti-aging properties by a synergistic coaction of the low aluminum and titanium contents, the presence of boron, and the spheroidizing of the cementite.

The present invention is directed to a cold rolled steel sheet having excellent deep drawability and excellent anti-aging properties which comprises about:

C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more, and wherein

Ti(wt %)/[1.5×S(wt %)+3.4×N(wt %)]≦about 1.0; and wherein

B is present in an amount of about 0.0001 to 0.0050 wt %, the balance being substantially iron with incidental impurities.

Furthermore, in the hot rolled steel strip used as a source for manufacturing the cold rolled steel sheet, the hot rolled steel comprises the above described steel composition and has a special structural cross section. It contains a cementite which, except the cementite in pearlite, satisfies particular conditions, that is, the cementite has a shape parameter of about S: 1.0 to 5.0 in accordance with the following equation (1):

$$S = (1/n)\sum_{i=1}^{n}(Lli/Lsi) \quad (1)$$

where Lli represents the length of a long side of the ith cementite particle (μm) and Lsi represents the length of a short side of the ith cementite particle (μm).

The cold rolled steel sheet of the present invention further comprises Nb, wherein the total amount of Nb and Ti content ranges from about 0.001 to 0.050 wt %. The cold rolled steel sheet further comprises about 0.05 to 1.00 wt % of Cr. The cold rolled steel sheet further comprises an O (oxygen) content of about 0.002 to 0.010 wt %. The sum of Si content and Al content is about 0.005 wt % or more, and the distribution mode of non-metallic inclusions is specified so that the non-metallic inclusions may be composed of at least one of an oxide, a sulfide and a nitride in which the average grain diameter ranges from about 0.01 to 0.50 μm and the average such distance ranges from about 0.5 to 5.0 μm.

Furthermore, the present invention is directed to a method of manufacturing the above-described cold rolled steel sheet and hot rolled steel sheet. That is, in the present invention, the steel slab comprises about:

C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more and

Ti(wt %)/[1.5×S(wt %)+3.4×N(wt %)]≦1.0; and

B is present in an amount of about 0.0001 to 0.0050 wt % and wherein the method comprises the steps of:

(a) reheating or holding the steel slab to a temperature of about 1100° C. or less; and (b) in a hot rolling process including a rough hot rolling step and a finishing hot rolling step, rough hot rolling the steel slab in such a manner that the relationship between a temperature T(°C.) and the reduction ratio R(%) in the final pass of the rough hot rolling step satisfies the following approximate condition:

$$0.02 \leqq R/T \leqq 0.08,$$

wherein R designates reduction ratio (%) and wherein T designates temperature in degrees Centigrade.

hot rolling the steel slab at about 850° C. or less in the finishing hot rolling step, and (c) coiling the resulting hot rolled steel sheet. The method of manufacturing the cold rolled steel sheet with excellent deep drawability and excellent anti-aging further comprises the steps of (d) cold rolling; and (e) in a continuous annealing process, keeping the resulting steel sheet for about five minutes or less in the range of the recrystallization temperature to about 850° C., cooling the steel sheet and allowing the steel sheet to reside for about 5 to below 120 seconds at a temperature in the range of about 500 to 300° C.

Furthermore, in the manufacturing method, when the steel slab is cast by a continuous casting process, the cast steel slab is cooled between about 1400 to 1100° C. at an average cooling velocity of about 10 to 100° C./min in the cooling step.

Further details will become apparent from the following description and examples, and from a study of the drawings.

DETAILED DESCRIPTION OF THE PREFERRED EMBODIMENTS

One illustrative set of specific examples of the present invention is described below. It is intended to be illustrative but not to define or to limit the scope of the invention.

Figure 1:
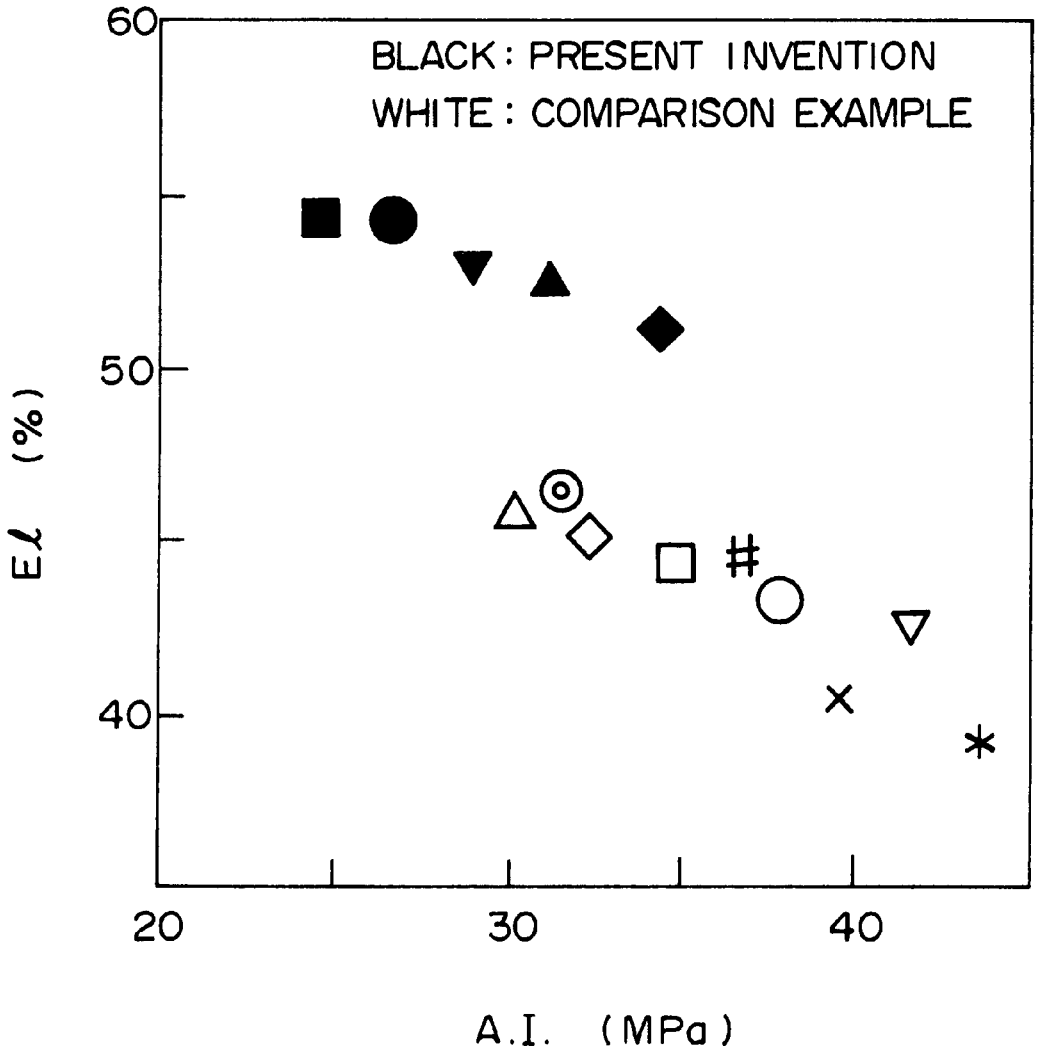
FIG. 1 is a graph showing a relationship between a total elongation (El) and aging index (A.I.).

A sheet bar is composed of a steel composition shown in Table 1, and its thickness is 30 mm. The sheet bar is reheated at a slab reheating temperature (SRT) of 1000–1100° C., and the sheet bar is then hot rolled in three passes. The finishing delivery temperature is 800° C., and the sheet thickness is 3.0 mm. The resulting steel sheet is heat treated by keeping for one hour at 600° C. equivalent to coiling in an actual production line. The steel sheet is cooled to 500° C. by furnace cooling (about 1° C./min). The steel sheet is cooled to room temperature by air cooling. The resulting hot rolled steel sheet is pickled. The hot rolled steel sheet is then cold rolled, so that a cold rolled steel sheet of 0.7 mm thick is formed. Then heat treatment as in a continuous annealing process is performed. That is, the steel sheet is reheated up to 800° C. at a reheating velocity of 10° C./sec, and it is then kept for 20 seconds. The steel sheet is cooled to 400° C. at a cooling velocity of 40° C./sec, and it is then kept for 120 seconds. The steel sheet is then cooled to room temperature at a cooling velocity of 10° C./sec. Temper rolling is performed at a reduction ratio of 0.8%. The longitudinal direction of a sample sheet is caused to coincide with the rolling direction of the steel sheet. In such a manner, a JIS-5 tensile test sheet is formed. Total elongation (El) and aging index (A.I.) are measured. The relationship between them is shown in FIG. 1. The symbols such as ●, ▲, ▼, ■, ♦, etc., used in the Table 1. have no special meanings each but aiming to illustrate visually the relationship between them in FIG. 1.

As a result the steel sheet, which is composed of component series (a composite addition of low Al, Ti and B) according to the present invention, has much larger El value than the steel sheet composed of the conventional component series in the same A.I. The steel sheet of the present invention has excellent workability. That is, without Ti and/or B, or when the amount of Al is high, it has become clear that it is not possible to obtain a low carbon killed steel which has excellent workability and excellent anti-aging properties as obtained by the present invention.

TABLE 1

(wt %)

| Steel | Symbol | C | Si | Mn | P | S | Al | N | Ti | B | Ti/ (1.5 S + 3.4 N) | B/N | SRT (° C.) | Note |
|---|---|---|---|---|---|---|---|---|---|---|---|---|---|---|
| A | ● | 0.026 | 0.011 | 0.09 | 0.006 | 0.004 | 0.004 | 0.0014 | 0.006 | 0.0031 | 0.56 | 2.21 | 1050 | Steel of Present Invention |
| B | ▲ | 0.031 | 0.009 | 0.11 | 0.007 | 0.007 | 0.005 | 0.0022 | 0.009 | 0.0035 | 0.50 | 1.59 | 1000 | Steel of Present Invention |
| C | ▼ | 0.027 | 0.022 | 0.05 | 0.008 | 0.009 | 0.008 | 0.0018 | 0.007 | 0.0034 | 0.36 | 1.89 | 1050 | Steel of Present Invention |
| D | ■ | 0.018 | 0.008 | 0.18 | 0.006 | 0.011 | 0.007 | 0.0025 | 0.011 | 0.0039 | 0.44 | 1.56 | 1000 | Steel of Present Invention |
| E | ♦ | 0.041 | 0.016 | 0.2 | 0.012 | 0.014 | 0.006 | 0.0015 | 0.022 | 0.0033 | 0.84 | 2.20 | 1000 | Steel of Present Invention |
| F | ○ | 0.019 | 0.006 | 0.18 | 0.009 | 0.008 | 0.024 | 0.0025 | — | — | — | — | 1050 | Steel of Comparison Example |
| D | Δ | 0.015 | 0.013 | 0.12 | 0.014 | 0.008 | 0.072 | 0.0023 | 0.025 | — | 1.26 | — | 1050 | Steel of Comparison Example |
| H | ▽ | 0.045 | 0.016 | 0.25 | 0.012 | 0.013 | 0.034 | 0.0028 | — | 0.0009 | — | 0.32 | 1100 | Steel of Comparison Example |
| I | □ | 0.025 | 0.008 | 0.21 | 0.007 | 0.008 | 0.045 | 0.0026 | 0.007 | — | 0.34 | — | 1100 | Steel of Comparison Example |
| J | ◇ | 0.035 | 0.018 | 0.14 | 0.009 | 0.011 | 0.018 | 0.0016 | 0.012 | — | 0.55 | — | 1000 | Steel of Comparison Example |
| K | ⊙ | 0.021 | 0.009 | 0.1 | 0.005 | 0.008 | 0.006 | 0.0021 | — | 0.0033 | — | 1.57 | 1000 | Steel of Comparison Example |
| L | X | 0.03 | 0.007 | 0.08 | 0.009 | 0.009 | 0.007 | 0.0033 | 0.007 | — | 0.28 | — | 1050 | Steel of Comparison Example |
| M | * | 0.027 | 0.009 | 0.09 | 0.011 | 0.010 | 0.005 | 0.0024 | — | — | — | — | 1050 | Steel of Comparison Example |
| N | # | 0.025 | 0.01 | 0.11 | 0.009 | 0.007 | 0.014 | 0.0023 | 0.006 | 0.0007 | 0.33 | 0.30 | 1050 | Steel of Comparison Example |

TABLE 2

(wt %)

| Steel | Symbol | C | Si | Mn | P | S | Al | N | Ti | B | Ti/ (1.5 S + 3.4 N) | B/N | FDT (° C.) | CT (° C.) | Note |
|---|---|---|---|---|---|---|---|---|---|---|---|---|---|---|---|
| O | ● | 0.035 | 0.015 | 0.12 | 0.007 | 0.005 | 0.006 | 0.0022 | 0.005 | 0.0033 | 0.33 | 1.50 | 810 | 600 | Steel of Present Invention |
| P | ▲ | 0.026 | 0.012 | 0.08 | 0.005 | 0.003 | 0.004 | 0.0018 | 0.008 | 0.0036 | 0.75 | 2.00 | 850 | 600 | Steel of Present Invention |
| Q | ▼ | 0.018 | 0.009 | 0.07 | 0.007 | 0.008 | 0.005 | 0.0018 | 0.006 | 0.0031 | 0.33 | 1.72 | 770 | 600 | Steel of Present |

TABLE 2-continued (wt %)

| Steel | Symbol | C | Si | Mn | P | S | Al | N | Ti | B | Ti/ (1.5 S + 3.4 N) | B/N | FDT (° C.) | CT (° C.) | Note |
|---|---|---|---|---|---|---|---|---|---|---|---|---|---|---|---|
| | | | | | | | | | | | | | | | Invention |
| R | ■ | 0.022 | 0.01 | 0.06 | 0.004 | 0.007 | 0.004 | 0.0021 | 0.016 | 0.0042 | 0.91 | 2.00 | 810 | 600 | Steel of Present Invention |
| S | ◆ | 0.019 | 0.008 | 0.13 | 0.007 | 0.008 | 0.008 | 0.0017 | 0.009 | 0.0038 | 0.51 | 2.24 | 810 | 600 | Steel of Present Invention |
| T | ○ | 0.038 | 0.011 | 0.12 | 0.008 | 0.007 | 0.008 | 0.0022 | 0.005 | — | 0.28 | — | 810 | 600 | Steel of Comparison Example |
| U | Δ | 0.026 | 0.011 | 0.14 | 0.009 | 0.006 | 0.005 | 0.0018 | — | — | — | — | 810 | 600 | Steel of Comparison Example |
| V | ▽ | 0.032 | 0.01 | 0.11 | 0.011 | 0.006 | 0.008 | 0.0019 | — | 0.0009 | — | 0.47 | 810 | 600 | Steel of Comparison Example |
| W | □ | 0.023 | 0.007 | 0.08 | 0.008 | 0.004 | 0.015 | 0.0026 | 0.012 | — | 0.81 | — | 810 | 600 | Steel of Comparison Example |
| X | ◇ | 0.032 | 0.009 | 0.14 | 0.012 | 0.013 | 0.018 | 0.0021 | 0.009 | — | 0.34 | — | 810 | 600 | Steel of Comparison Example |
| Z | # | 0.021 | 0.01 | 0.11 | 0.009 | 0.007 | 0.006 | 0.0019 | — | 0.0031 | — | 1.63 | 800 | 600 | Steel of Comparison Example |

The sheet bar is composed of the steel composition shown in Table 2, and its thickness is 30 mm. The sheet bar is reheated up to 1050° C. The sheet bar is hot rolled through three passes at a finishing delivery temperature ranging from 810° C. to 900° C. so that the finishing sheet thickness may be 3.2 mm. The heat treatment is performed correspondingly to the coiling by keeping for one hour at 600° C. The steel sheet is cooled to 500° C. by furnace cooling (about 2° C./min or less). The steel sheet is cooled to room temperature by air cooling so as to produce the hot rolled steel sheet. After the hot rolled steel sheet is pickled, a cold rolled steel sheet 0.8 mm thick is formed. The steel sheet is reheated up to 800° C. at a reheating velocity of 6° C./sec, and it is then kept for 30 seconds. The steel sheet is cooled to 400° C. at a cooling velocity of 30° C./sec, and is then kept for 150 seconds at 400° C. Continuous annealing heat treatment is then performed at a cooling velocity of 6° C./sec so as to reach room temperature. Temper rolling is performed at a reduction ratio of 0.8% so as to obtain a cold and annealed steel sheet. The directions of 0°, 45° and 90° relative to the rolling direction of the resulting steel sheets are caused to coincide with the longitudinal direction of the sample bar. In such a manner, a JIS-5 tensile test sheet is formed. An average value of the r value, the El and the A.I. are obtained. It should be noted that the El and the A.I. values are characteristics of the direction of 0°. The average value of r value:$\bar{r}$ is the value obtained by the following equation (2):

$$\text{the average value of } \bar{r}=(X_0+2X_{45}+X_{90})/4 \quad (2)$$

where, $X_0$ represents the characteristic value in the direction 0° relative to the direction of rolling, $X_{45}$ represents the characteristic value in the direction 45° relative to the direction of rolling, and $X_{90}$ represents the characteristic value in the direction 90° relative to the direction of rolling.

The shape parameter (S) of a cementite of the above hot rolled steel sheet is obtained in the following manner. A thickness cross section of a hot rolled steel sheet is observed through a scanning type electron microscope of 1000× magnification from one surface to the opposite surface of the sheet parallel to the rolling direction so as to observe the shape of the cementite. An image analysis system device is used to measure the long side and the short side of each precipitate. The value S is calculated using the following equation (1):

$$S=(1/n)\sum_{i=1}^{n}(Lli/Lsi) \quad (1)$$

where

Lli represents the length of the long side of each ith cementite (μm), and

Lsi represents the length of the short side of each ith cementite (μm).

Figure 2:
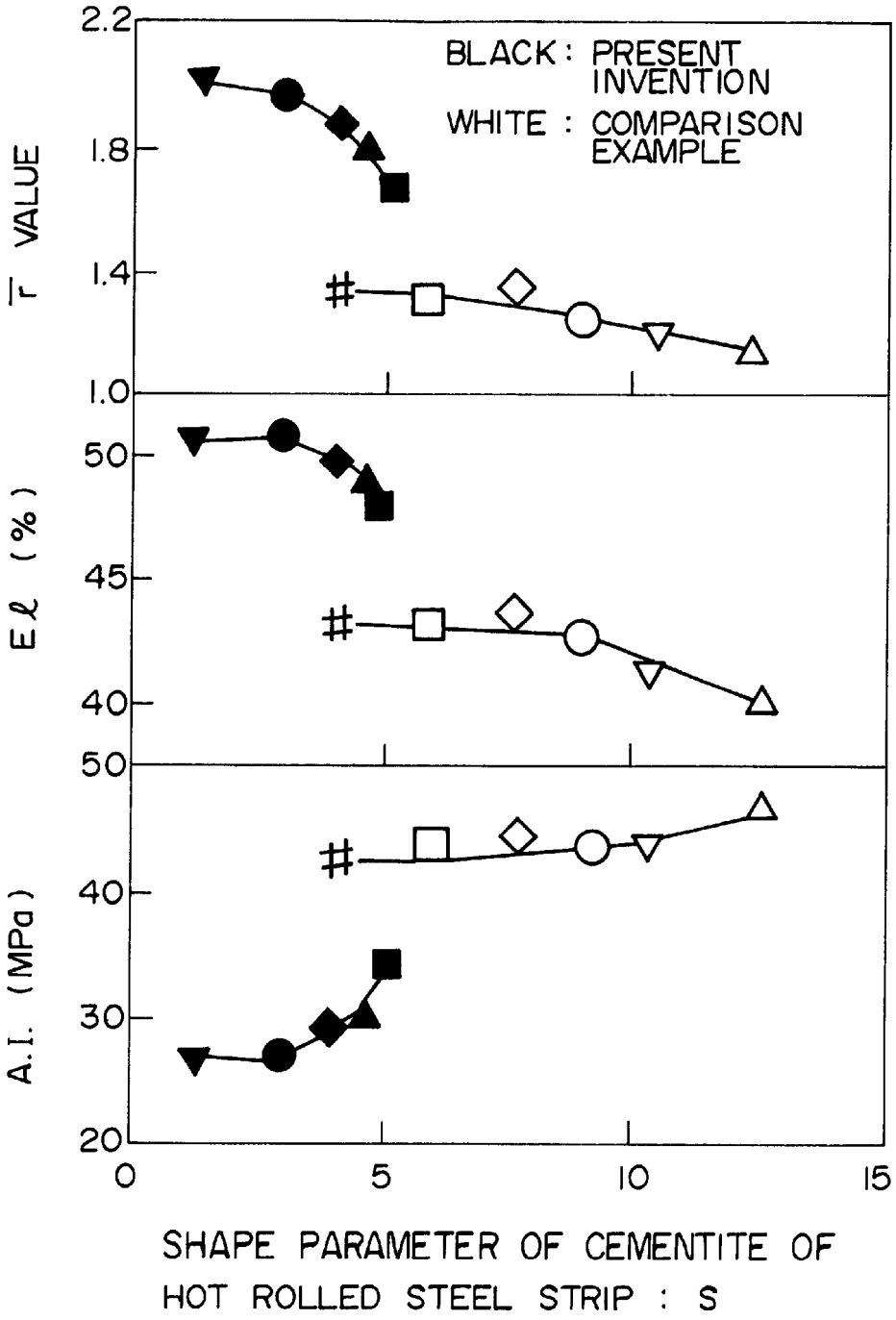
FIG. 2 is a graph showing a relationship among a shape parameter of a cementite in a hot rolled steel strip: S, the total elongation (El), the r value and the aging index (A.I.) of the steel.
Figure 3:
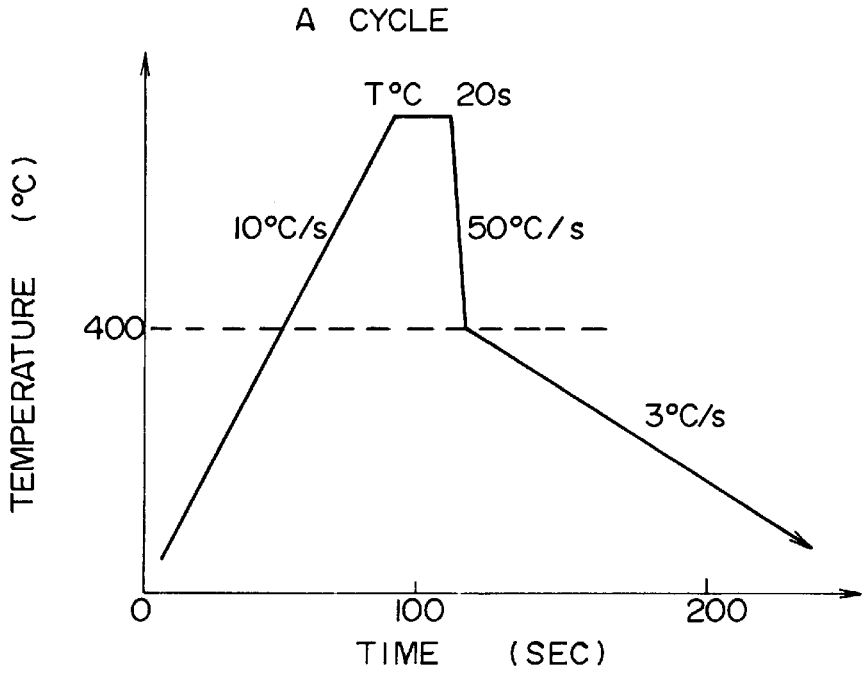
FIG. 3 represents comparative graphs showing heat cycles of recrystallization annealings.
Figure 3:
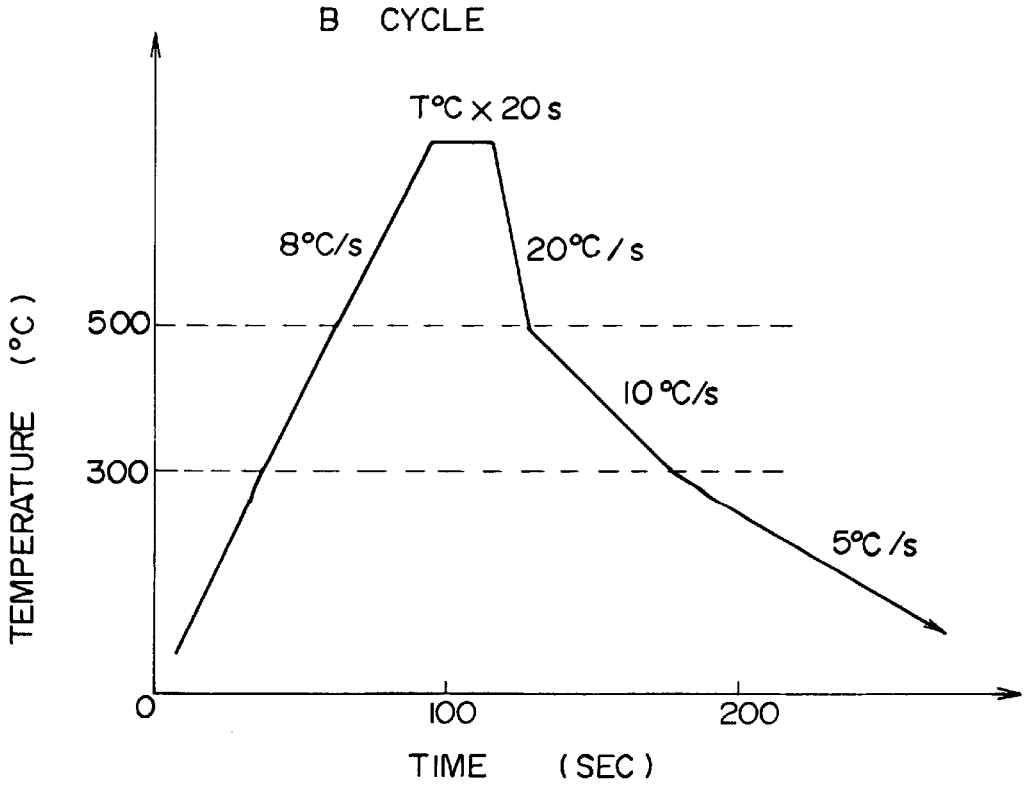

FIG. 2 shows the relationship among the shape parameter of the cementite of the hot rolled steel sheet (S), the El, the $\bar{r}$ value and the A.I. of the cold rolled and annealed steel sheet. The symbols such as ●, ▲, ▼, ■, ◆ etc., used in the Table 2. Have no special meanings each but aiming to illustrate visually the relationship among them in FIG. 2. In the steel sheet composed of the component series (the composite addition of low Al, Ti and B) of the present invention, the shape parameter S is in the range of 5.0 or less. The El and the $\bar{r}$ value are greatly improved. The A.I. is reduced. In order to reduce the value S, the finishing delivery temperature (FDT) is reduced in the hot rolling, and the cooling velocity from the coiling to 500° C. is reduced, thereby promoting a diffusion of C, and enabling the manufacturer to spheroidize the cementite. With the conventional component series, that is, without Ti and/or B, or when the amount of Al is high, it is not possible to obtain low carbon killed steel which has excellent workability and excellent anti-aging properties obtained by the present invention. Furthermore, if the hot rolled steel sheet is composed of the composition according to the present invention and its shape parameter (S) of the cementite ranges from about 1.0 to 5.0, it has become clear that a cold rolled steel sheet with good deep drawability and anti-aging property can be obtained. Accordingly, in the hot rolled steel sheet according to the present invention, preferably, the shape parameter(s) of the cementite except the cementite in the pearlite is set to the range from about 1.0 to 5.0.

The reason is as follows. Assume that a bar-shaped or sheet-shaped cementite with an S value greater than about 5.0 is precipitated in the step of hot rolling the steel sheet. Upon annealing after cold rolling, many crystals of (110) orientation having an adverse effect on deep drawability are generated from the vicinity of the bar-shaped or sheet-shaped cementite. Therefore, workability is significantly reduced. On the other hand, when the precipitated ellipsoidal or spherical cementite, whose S value is ≦5.0, the generation of crystals of (110) orientation is suppressed. Thus, the generation and growth of crystals of (111) orientation are promoted, thereby improving deep drawability.

Needless to say, approximately 1.0 is defined as a lower limit, since the ratio of the long side to the short side cannot be below about 1.0 in the equation (1).

Next, the reasons for important limitations in the steel components and the manufacturing method will be described.

C: above about 0.015 to 0.15 wt %.

The content of C is above about 0.015 wt %. In order to reduce the amount of C to 0.015 wt % or less, a decarburization treatment is necessary in the steel making process. This causes the cost to be considerably increased. Furthermore, when the amount of C exceeds about 0.15 wt %, the crystalline grain becomes considerably small. This causes the value El to be small, resulting in deterioration of workability. Accordingly, the upper limit of C is defined as about 0.15 wt %. Preferably, C is in the range from about 0.015 to 0.060 wt %.

Si: about 1.0 wt % or less

When the content of Si is above about 1.0 wt %, the material becomes harder, thereby resulting in deterioration of workability. When silicon or a silicon alloy is used as a deoxidizer in the steel making process, preferably, Si is added for sufficient deoxidation so that about 0.001 wt % or more of Si may be contained in the steel. Preferably, Si is in the range from about 0.001 to 0.050 wt %.

Mn: about 0.01 to 1.50 wt %

Typically, Mn is added as an element which fixes S causing a red shortness as MnS. In the present invention, since S is fixed by Ti, Mn is added as an element for improving strength. In order to achieve the effect, about 0.01 wt % or more of Mn is required. On the other hand, a content above about 1.50 wt % causes the crystalline grain to be finer. This causes the material to be hardened, thereby resulting in deterioration of workability. The cost of the steel is also increased. Accordingly, in the present invention, Mn is in the range from about 0.01 to 1.50 wt %. Preferably, Mn ranges from about 0.05 to 0.50 wt %.

P: about 0.10 wt % or less

P is a substitution type solid solution element. A P content above about 0.10 wt % causes the material to be hardened. Workability is deteriorated. Accordingly, in the present invention, P is in the range of about 0.10 wt % or less. Preferably, P ranges from about 0.001 to 0.030 wt %.

S: about 0.003 to 0.050 wt %

Normally, since S causes red shortness, S is an impurity element which should be avoided as much as possible in the steel. However, in the present invention, when the content of S is less than about 0.003 wt %, a fine sulfide is formed. This deteriorates the material. When the content is more than 0.050 wt %, precipitated sulfide increases. This deteriorates workability. In the present invention, S is in the range from about 0.003 to 0.050 wt %. In order to maintain workability, to promote precipitation of the cementite by using the sulfide as a precipitation site and thereby to improve anti-aging properties, S is preferably in the range from about 0.005 to 0.030 wt %.

Al: about 0.001 to below 0.010 wt %

In a normal Al killed steel, Al is added as a deoxidizer. Al is also added to precipitate AlN and to avoid aging due to solute nitrogen in the steel. However, in the present invention, since nitride former elements Ti and B are added, the addition of Al is sufficient to the extent that deoxidation is performed or the oxygen content is adjusted. For the purpose, Al is required to be added so that about 0.001 wt % or more of Al may be present. On the other hand, when the content of Al is over about 0.010 wt %, the amount of non-metallic inclusion such as $Al_2O_3$ is increased. There is a danger that the non-metallic inclusion will cause cracking during pressing. A high content of Al causes solute Al to be increased. Grain growth is inhibited during annealing, thereby resulting in deterioration of workability. Accordingly, the content of Al ranges from about 0.001 to 0.010 wt %. Preferably, the content of Al ranges from about 0.003 to 0.010 wt %.

N: about 0.0001 to 0.0050 wt %

In a common mild steel sheet, since N causes aging by introducing solute nitrogen, thereby resulting in deterioration of the steel, N must be reduced in amount as much as possible. However, we have discovered that a nitride can function and serve as a precipitation site for cementite. Accordingly, N is a necessary element in accordance with this invention. When the content of N is less than about 0.0001 wt %, the function of forming a precipitation site of cementite cannot be achieved. On the other hand, when the content of N exceeds about 0.0050 wt %, a large amount of expensive Ti must be added in order to fix the N and the cost of the molten steel is considerably increased. In the present invention, the amount of N ranges from about 0.0001 to 0.0050 wt %. Preferably, the amount of N ranges from about 0.0001 to 0.0030 wt %.

B: about 0.0001 to 0.005 wt %

In the cooling process upon continuous annealing, in order to use a boron precipitate ($Fe_2B$, Fex(C,B)y) as a precipitation site for cementite, a B content of at least about 0.0001 wt % or more is necessary. With a B content of more than about 0.0050 wt %, solute B causes deterioration of the material. Preferably, the content of B is in the range from about 0.5×N(wt %) to about 3.0×N(wt %) is satisfied relative to N, more preferably, about 1.5×N(wt %) to 3.0×N(wt %). In the latter range, precipitation effect of the cementite by the Boron series precipitate is better promoted.

Ti: about 0.001 wt % or more and

Ti(wt %)/[1.5×S(wt %)+3.4×N(wt %)]≦about 1.0

Ti forms a carbide, a nitride and a sulfide. In the present invention, in order that N is fixed as TiN and that the Ti series non-metallic inclusion becomes the precipitation site of the cementite during the continuous annealing, a content of Ti of about 0.001 wt % or more is necessary. MnS deteriorates workability. Therefore, in order to precipitate the least possible MnS, it is necessary to set Ti(wt %)/[1.5×S(wt %)+3.4×N(wt %)]≦about 1.0 and to precipitate a Ti containing sulfide (TiS, $Ti_4C_2S_2$) That is, since TiS and $Ti_4C_2S_2$ form more grain than MnS, they cause less deterioration of stretch flanging. Furthermore, a content of Ti(wt %)/[1.5×S(wt %)+3.4×N(wt %)]> about 1.0 results in precipitation of ultrafine TiC whose diameter is 0.050 μm or less. During continuous annealing, recrystallization behavior is delayed. In addition, thereafter, grain growth is suppressed, thereby resulting in deterioration of workability. Accordingly, the range of content of Ti is defined as about 0.001 wt % or more and Ti(wt %)/[1.5×S(wt %)+3.4×N(wt %)]≦ about 1.0, preferably, about 0.001 wt % or more and Ti(wt %)/[1.5×S(wt %)+3.4×N(wt %)]≦ about 0.8.

Nb: the total amount of Nb and Ti ranging from 0.001 to 0.050 wt %

Nb forms an oxide ($Nb_xO_y$) and promotes precipitation of the nitrides (TiN, BN or the like). The nitride is precipitated as a precipitation site by the cementite so as to improve the anti-aging properties. Therefore, preferably, Nb is present. In order to achieve an excellent effect, it is desirable that a total amount of Ti and Nb ranging from about 0.001 to 0.050 wt % is present. That is, if the total Ti and Nb content is below about 0.001 wt %, little effect is obtained. If the content exceeds about 0.050 wt %, fine NbC is precipitated, thereby resulting in deterioration of deep drawability. More preferably, the total amount of Ti and Nb ranges from about 0.001 to 0.030 wt %.

Cr: about 0.05 to 1.00 wt %

The cold rolled steel sheet of the present invention may contain Cr besides the components described above. Cr has the effect that the carbide is formed without deterioration of workability. This improves the anti-aging properties. In order to achieve excellence, a content of Cr of at least about 0.05 wt % or more is preferable. However, a content of Cr over about 1.00 wt % unduly increases the cost of the steel. Accordingly, when Cr is present, the content of Cr ranges from about 0.05 to 1.00 wt %, more preferably, from about 0.05 to 0.50 wt %.

Oxygen content: about 0.002 to 0.01 wt %; the sum of Si content and Al content: about 0.005 wt % or more The oxide ($Si_xO_y$, $Al_xO_y$, $Mn_xO_y$, $Ti_xO_y$, $Nb_xO_y$, $B_xO_y$ or the like) serves as a precipitation site for the sulfide ($Ti_4C_2S_2$, TiS, MnS) and the nitride (TiN, BN). The sulfide and the nitride can be also used as precipitation sites for the cementite. Accordingly, a content of the oxide is preferable. In order to contain the oxide, preferably, the oxygen content is at least about 0.002 wt %. On the other hand, a content over about 0.010 wt % causes the oxide to be too large. This tends to cause press cracking due to inclusion. Therefore, preferably, the oxygen content ranges from about 0.002 to 0.010 wt %.

When the oxides, more specifically, $Si_xO_y$ or $Al_xO_y$ are positively used as precipitation sites of the sulfide, the nitride and the cementite, the sum of Si and Al contents is preferably about 0.005 wt % or more. Since a content less than about 0.005 wt % has little effect, the lower limit of the sum of Si plus Al is defined as about 0.005 wt %, more preferably, ranging from about 0.010 to 0.050 wt %.

Distribution of the oxide, the sulfide and the nitride

Preferably, the oxide, the sulfide and the nitride have average diameters ranging from about 0.01 to 0.50 $\mu$m and average space ranging from about 0.5 to 5.0 $\mu$m. An average diameter below about 0.01 $\mu$m is too fine. An average diameter above about 0.50 $\mu$m is too coarse. Therefore, the precipitation of the cementite is suppressed. When the average space is less than about 0.5 $\mu$m, the distribution is too dense. Therefore, crystalline grain growth is suppressed, thereby resulting in deterioration of important characteristics such as elongation. When the average space is more than about 5.0 $\mu$m, the space is too large. This is disadvantageous to the precipitation of the cementite.

Although the steel manufacturing conditions are not particularly limited, manufacturing is preferably carried out as described below. Regarding the particular temperature range of the slab, the cooling velocity affects the generation of such non-metallic inclusions as oxides, nitrides and sulfides to form precipitation sites for cementite during annealing after cold rolling. Therefore, preferably, the cooling velocity is restricted to about 1400 to 1100° C. In this temperature range, a cooling velocity below about 10° C./min causes the precipitate to be coarsely roughly dispersed. On the other hand, when the cooling velocity is above about 100° C./min, the generation of the oxide, the nitride and the sulfide is suppressed. The effect of the oxide, the nitride and the sulfide as precipitation sites of the cementite is lost. For these reasons, preferably, the slab cooling velocity ranges from about 10 to 100° C./min.

The slab reheating temperature is as low as about 1100° C. or lower prior to the hot rolling process. In the hot rolling process, a finishing rolling temperature is set to a critical temperature $Ar_3$ or more. This is preferable when a steel sheet with good El and $\bar{r}$ values is manufactured. There is no problem that various rolling methods may be applied to the present invention, including methods such as direct rolling (HDR) without once cooling the slab to room temperature, hot charge rolling (HCR), hot rolling with lubrication and fully continuous hot rolling or endless hot rolling system with a sheet bar joining apparatus.

Furthermore, reheating or keeping is performed at a temperature of about 1100° C. or less. Rough hot rolling and finishing hot rolling at about 850° C. or less are then performed in the hot rolling process. At this time, in the final pass of rough hot rolling, preferably the relationship between temperature T(°C.) and reduction ratio R(%) satisfies the condition $0.02 \leqq R/T \leqq$ about 0.08 so as to perform hot rolling and coiling in the temperature range of about 550 to 750° C. Under conditions of R/T<about 0.02, after annealing after cold rolling, pressing is subject to a surface defect referred to as a ridging. On the other hand, when R/T is greater than about 0.08, the reduction ratio is increased in rough hot rolling, thereby resulting in increase of load on facilities. When high temperature coiling is performed at about 750° C. or more, the amount of scale formation is increased. Thus, since pickling ability is degraded, it is desirable that coiling is performed at about 700° C. or less. Preferably the cooling velocity from coiling completion to about 500° C. is set to about 1.5° C./min or less in order to advantageously spheroidize the cementite in the hot rolled steel strip.

Although it is not necessary to particularly restrict the cold rolling conditions, a high reduction ratio is advantageous to obtain cold rolled steel having a high $\bar{r}$ value. Preferably, the reduction ratio is about 40% or more, more preferably about 60% or more.

Preferably, continuous annealing is adopted so as to perform recrystallization annealing. Thus, cleaning facilities prior to annealing and temper rolling facilities after annealing can be continuous. This can not only improve the distribution of the coil, but also greatly reduces the number of days for manufacturing as compared with conventional box annealing.

For a recrystallization annealing temperature, preferably, the steel is kept for about 5 minutes or less at a temperature ranging from the recrystallization temperature to about 850° C. Below the recrystallization temperature, a deformed strain remains. This results in a material having high strength and low elongation that is subject to cracking at the forming process. On the other hand, a (111) recrystallization structure is randomized at a temperature exceeding about 850° C. As a result, press forming is subject to press cracking.

In the cooling process of continuous annealing, the steel preferably resides for a relatively long time in a temperature range (of about 300 to 500° C.) advantageous to the precipitation of the solute C. In such a temperature range, preferably, it is during at least about 5 seconds or more that the cementite is precipitated. However, when a time above about 120 seconds is necessary, large facilities are necessary, or the line velocity must be reduced. Therefore, the cost of facilities is inevitably increased, or productivity is considerably reduced. This, of course, must be avoided.

Next, multiple specific examples will be described in detail.

EXAMPLE 1

The slab was composed of the steel composition shown in Tables 3-a, 3-b and 3-c, and its thickness ranged from 300 to 320 mm. As shown in Tables 4-a, 4-b and 4-c, the slab is reheated at 900 to 1250° C. In 3-pass rough hot rolling, the temperature and reduction ratio were varied in the final pass. Sheet bars 25 to 30 mm thick were formed. In a 7-stand finishing roll mill, the hot rolling was performed so that the finishing delivery temperature ranged from 700 to 900° C. and the finishing sheet thickness ranged from 3.0 to 3.5 mm. The coiling was performed at a temperature of 700° C. or less. After pickling, the cold rolling was performed so as to form cold rolled steel sheet of 0.8 mm in thickness. Thereafter, under the continuous annealing conditions shown in Tables 4-a, 4-b and 4-c, recrystallization annealing was performed. Temper rolling was performed at a reduction ratio of 0.8%. The directions of 0°, 45° and 90° relative to the rolling direction of the obtained steel sheets were caused to coincide with the longitudinal direction of the sample bar. In such a manner, the JIS-5 tensile test sheet was performed. The average values of r value and A.I. were obtained. The mechanical characteristics of YS, TS and El were obtained in the direction of 0°. The average values $\bar{r}$ of the r s values were obtained by the following equation (2), and shown in Table 4:

$$\text{the average value of r value}=(X_0+2X_{45}+X_{90})/4 \quad (2)$$

where, $X_0$ represents the characteristics value in the direction 0° relative to the direction of rolling, $X_{45}$ represents the characteristics value in the direction 45° relative to the direction of rolling, $X_{90}$ represents the characteristics value in the direction 90° relative to the direction of rolling.

TABLE 3-a (wt %)

| Steel | C | Si | Mn | P | S | Al | N | Ti | B | Nb | Cr | Ti/(1.5 S + 3.4 N) | B/N | Note |
|---|---|---|---|---|---|---|---|---|---|---|---|---|---|---|
| 1 | 0.025 | 0.012 | 0.11 | 0.005 | 0.012 | 0.006 | 0.0018 | 0.015 | 0.0032 | — | — | 0.62 | 1.78 | Applied Steel |
| 2 | 0.031 | 0.013 | 0.09 | 0.002 | 0.007 | 0.005 | 0.0014 | 0.005 | 0.0035 | — | — | 0.33 | 2.50 | Applied Steel |
| 3 | 0.027 | 0.008 | 0.05 | 0.008 | 0.018 | 0.008 | 0.0022 | 0.025 | 0.0036 | — | — | 0.73 | 1.64 | Applied Steel |
| 4 | 0.016 | 0.008 | 0.14 | 0.006 | 0.015 | 0.005 | 0.0021 | 0.024 | 0.0041 | — | — | 0.81 | 1.95 | Applied Steel |
| 5 | 0.041 | 0.006 | 0.1 | 0.001 | 0.027 | 0.006 | 0.0019 | 0.007 | 0.0031 | — | — | 0.15 | 1.63 | Applied Steel |
| 6 | 0.028 | 0.005 | 0.25 | 0.005 | 0.009 | 0.028 | 0.0021 | 0.018 | — | — | — | 0.87 | — | Steel of Comparison Example |
| 7 | 0.052 | 0.013 | 0.31 | 0.011 | 0.017 | 0.033 | 0.0033 | — | 0.0012 | — | — | — | 0.36 | Steel of Comparison Example |
| 8 | 0.026 | 0.011 | 0.09 | 0.007 | 0.009 | 0.007 | 0.0023 | 0.024 | 0.0009 | — | — | 1.13 | 0.39 | Steel of Comparison Example |
| 9 | 0.031 | 0.005 | 0.18 | 0.008 | 0.002 | 0.006 | 0.0018 | 0.007 | — | — | — | 0.77 | — | Steel of Comparison Example |
| 11 | 0.025 | 0.008 | 0.11 | 0.008 | 0.006 | 0.015 | 0.0022 | — | — | — | — | — | — | Steel of Comparison Example |
| 12 | 0.019 | 0.015 | 0.08 | 0.009 | 0.016 | 0.004 | 0.0035 | 0.008 | 0.0066 | — | — | 0.22 | 1.89 | Steel of Comparison Example |
| 13 | 0.022 | 0.032 | 0.14 | 0.006 | 0.008 | 0.006 | 0.0052 | 0.014 | 0.0018 | — | — | 0.47 | 0.35 | Steel of Comparison Example |
| 14 | 0.033 | 0.058 | 0.12 | 0.007 | 0.024 | 0.008 | 0.0021 | — | 0.0012 | — | — | — | 0.57 | Steel of Comparison Example |
| 16 | 0.036 | 0.008 | 0.26 | 0.007 | 0.024 | 0.006 | 0.0015 | 0.008 | 0.0031 | — | — | 0.19 | 2.07 | Applied Steel |
| 17 | 0.017 | 0.01 | 0.13 | 0.006 | 0.007 | 0.004 | 0.002 | 0.007 | 0.0038 | — | — | 0.40 | 1.90 | Applied Steel |
| 18 | 0.029 | 0.005 | 0.35 | 0.001 | 0.007 | 0.008 | 0.0019 | 0.006 | 0.0036 | — | — | 0.35 | 1.89 | Applied Steel |
| 19 | 0.021 | 0.012 | 0.09 | 0.007 | 0.009 | 0.006 | 0.002 | 0.007 | 0.0022 | — | — | 0.34 | 1.10 | Applied Steel |
| 20 | 0.033 | 0.009 | 0.07 | 0.008 | 0.014 | 0.008 | 0.0025 | 0.005 | 0.003 | — | — | 0.17 | 1.20 | Applied Steel |
| 21 | 0.017 | 0.006 | 0.11 | 0.004 | 0.006 | 0.005 | 0.0014 | 0.006 | 0.0016 | — | — | 0.44 | 1.14 | Applied Steel |
| 22 | 0.038 | 0.011 | 0.1 | 0.006 | 0.009 | 0.008 | 0.0021 | 0.009 | 0.0027 | — | — | 0.44 | 1.29 | Applied Steel |

TABLE 3-b (wt %)

| Steel | C | Si | Mn | P | S | Al | N | Ti | B | Nb | Cr | Ti/(1.5 S + 3.4 N) | B/N | Note |
|---|---|---|---|---|---|---|---|---|---|---|---|---|---|---|
| 23 | 0.022 | 0.009 | 0.08 | 0.005 | 0.012 | 0.006 | 0.0021 | 0.012 | 0.0035 | — | — | 0.48 | 1.67 | Applied Steel |
| 24 | 0.031 | 0.013 | 0.09 | 0.002 | 0.006 | 0.005 | 0.0015 | 0.011 | 0.0032 | — | — | 0.78 | 2.13 | Applied Steel |
| 25 | 0.027 | 0.008 | 0.06 | 0.008 | 0.018 | 0.008 | 0.0019 | 0.007 | 0.0031 | — | — | 0.21 | 1.63 | Applied Steel |
| 26 | 0.026 | 0.008 | 0.08 | 0.006 | 0.015 | 0.005 | 0.0021 | 0.025 | 0.0041 | — | — | 0.84 | 1.95 | Applied Steel |
| 27 | 0.041 | 0.006 | 0.09 | 0.001 | 0.027 | 0.006 | 0.0019 | 0.031 | 0.0045 | — | — | 0.66 | 2.37 | Applied Steel |

TABLE 3-b-continued (wt %)

| Steel | C | Si | Mn | P | S | Al | N | Ti | B | Nb | Cr | Ti/ (1.5 S + 3.4 N) | B/N | Note |
|---|---|---|---|---|---|---|---|---|---|---|---|---|---|---|
| 28 | 0.028 | 0.005 | 0.05 | 0.005 | 0.009 | 0.007 | 0.0021 | 0.018 | — | — | — | 0.87 | — | Steel of Comparison Example |
| 29 | 0.033 | 0.013 | 0.18 | 0.012 | 0.014 | 0.005 | 0.0033 | 0.035 | 0.0005 | — | — | 1.09 | 0.15 | Steel of Comparison Example |
| 30 | 0.061 | 0.016 | 0.12 | 0.008 | 0.012 | 0.035 | 0.0025 | — | 0.0003 | — | — | — | 0.12 | Steel of Comparison Example |
| 31 | 0.028 | 0.006 | 0.09 | 0.011 | 0.008 | 0.007 | 0.0021 | — | — | — | — | — | — | Steel of Comparison Example |
| 32 | 0.068 | 0.012 | 0.12 | 0.015 | 0.006 | 0.008 | 0.0019 | 0.026 | 0.0015 | — | — | 1.68 | 0.79 | Steel of Comparison Example |
| 33 | 0.033 | 0.018 | 0.23 | 0.007 | 0.008 | 0.015 | 0.0025 | — | 0.0008 | — | — | — | 0.32 | Steel of Comparison Example |
| 34 | 0.022 | 0.009 | 0.17 | 0.005 | 0.011 | 0.045 | 0.0021 | — | — | — | — | — | — | Steel of Comparison Example |
| 35 | 0.018 | 0.012 | 0.16 | 0.009 | 0.012 | 0.003 | 0.0065 | 0.013 | 0.0055 | — | — | 0.32 | 0.85 | Steel of Comparison Example |
| 36 | 0.034 | 0.031 | 0.08 | 0.008 | 0.008 | 0.006 | 0.0026 | — | 0.0011 | — | — | — | 0.42 | Steel of Comparison Example |
| 37 | 0.031 | 0.005 | 0.08 | 0.004 | 0.005 | 0.005 | 0.0013 | 0.009 | 0.0038 | — | — | 0.76 | 2.92 | Applied Steel |
| 38 | 0.019 | 0.009 | 0.11 | 0.003 | 0.013 | 0.002 | 0.0022 | 0.011 | 0.0031 | — | — | 0.41 | 1.41 | Applied Steel |
| 41 | 0.036 | 0.008 | 0.12 | 0.003 | 0.006 | 0.005 | 0.002 | 0.007 | 0.0023 | — | — | 0.44 | 1.15 | Applied Steel |
| 42 | 0.03 | 0.012 | 0.09 | 0.006 | 0.009 | 0.006 | 0.0017 | 0.005 | 0.0019 | — | — | 0.26 | 1.12 | Applied Steel |
| 43 | 0.027 | 0.005 | 0.05 | 0.01 | 0.011 | 0.004 | 0.0019 | 0.009 | 0.002 | — | — | 0.39 | 1.05 | Applied Steel |
| 44 | 0.033 | 0.007 | 0.08 | 0.009 | 0.005 | 0.008 | 0.0022 | 0.004 | 0.0024 | — | — | 0.27 | 1.09 | Applied Steel |
| 45 | 0.019 | 0.011 | 0.1 | 0.009 | 0.008 | 0.007 | 0.0027 | 0.011 | 0.0035 | — | — | 0.52 | 1.30 | Applied Steel |
| 46 | 0.027 | 0.009 | 0.13 | 0.011 | 0.007 | 0.006 | 0.0019 | 0.009 | 0.0038 | — | — | 0.53 | 2.00 | Applied Steel |
| 47 | 0.035 | 0.008 | 0.1 | 0.012 | 0.009 | 0.009 | 0.003 | 0.008 | 0.0036 | — | — | 0.34 | 1.20 | Applied Steel |
| 48 | 0.03 | 0.015 | 0.09 | 0.01 | 0.01 | 0.005 | 0.0025 | 0.01 | 0.0031 | — | — | 0.43 | 1.24 | Applied Steel |

TABLE 3-c (wt %)

| Steel | C | Si | Mn | P | S | Al | N | Ti | B | Nb | Cr | Ti/ (1.5 S + 3.4 N) | B/N | Note |
|---|---|---|---|---|---|---|---|---|---|---|---|---|---|---|
| 49 | 0.021 | 0.01 | 0.07 | 0.006 | 0.008 | 0.002 | 0.0015 | 0.002 | 0.0021 | — | — | 0.12 | 1.4 | Applied Steel |
| 50 | 0.045 | 0.01 | 0.26 | 0.012 | 0.008 | 0.007 | 0.0036 | 0.026 | 0.0036 | — | — | 1.07 | 1.0 | Steel of Comparison Example |
| 51 | 0.038 | 0.02 | 0.21 | 0.014 | 0.007 | 0.049 | 0.0041 | 0.005 | 0.0135 | — | — | 0.20 | 3.3 | Steel of Comparison Example |
| 52 | 0.061 | 0.01 | 0.22 | 0.011 | 0.009 | 0.021 | 0.9062 | — | 0.0022 | 0.002 | — | — | 0.4 | Steel of Comparison Example |
| 53 | 0.035 | 0.03 | 0.09 | 0.012 | 0.007 | 0.006 | 0.0024 | 0.007 | 0.0036 | 0.003 | 0.07 | 0.38 | 1.5 | Applied Steel |
| 54 | 0.041 | 0.01 | 0.14 | 0.007 | 0.009 | 0.005 | 0.0019 | 0.009 | 0.0038 | — | — | 0.45 | 2.0 | Applied Steel |
| 55 | 0.017 | 0.02 | 0.1 | 0.009 | 0.011 | 0.007 | 0.0026 | 0.006 | 0.0042 | 0.003 | — | 0.24 | 1.6 | Applied Steel |

TABLE 4-a1

| | Slab | | | | Conditions of Hot Rolling | | | | Shape | Continuous Annealing | |
|---|---|---|---|---|---|---|---|---|---|---|---|
| Steel | Thickness (mm) | Reheating Method | Reheating Temperature (° C.) | Thickness of Sheet Bar (mm) | Finishing Delivery Temperature (° C.) | Thickness of Hot Rolled Steel Sheet (mm) | Coiling Temperature (° C.) | Cooling Velocity (° C./min) | Parameter S | Cycle | Temperature (° C.) |
| 1 | 320 | Reheating | 1050 | 25 | 880 | 3 | 650 | 1.4 | 3.4 | A | 800 |
| 2 | 320 | Reheating | 1050 | 25 | 880 | 3 | 650 | 1.4 | 3.0 | A | 800 |

TABLE 4-a1-continued

| | Slab | | | | Conditions of Hot Rolling | | | | Shape | Continuous Annealing | |
|---|---|---|---|---|---|---|---|---|---|---|---|
| Steel | Thickness (mm) | Reheating Method | Reheating Temperature (° C.) | Thickness of Sheet Bar (mm) | Finishing Delivery Temperature (° C.) | Thickness of Hot Rolled Steel Sheet (mm) | Coiling Temperature (° C.) | Cooling Velocity (° C./min) | Parameter S | Cycle | Temperature (° C.) |
| 3 | 320 | Reheating | 1050 | 25 | 880 | 3 | 650 | 1.4 | 3.7 | A | 800 |
| 4 | 320 | Reheating | 1000 | 25 | 820 | 3 | 700 | 1.5 | 4.1 | A | 800 |
| 5 | 320 | Reheating | 1000 | 25 | 820 | 3 | 700 | 1.5 | 4.0 | A | 800 |
| 6 | 320 | Reheating | 1050 | 25 | 850 | 3 | 600 | 1.2 | 10.3 | A | 800 |
| 7 | 320 | Reheating | 1050 | 25 | 850 | 3 | 600 | 1.2 | 3.2 | A | 800 |
| 8 | 320 | Reheating | 1050 | 25 | 850 | 3 | 600 | 1.2 | 3.8 | A | 800 |
| 9 | 320 | Reheating | 1050 | 25 | 850 | 3 | 600 | 1.2 | 8.6 | A | 800 |
| 11 | 320 | Reheating | 1050 | 25 | 850 | 3 | 650 | 1.3 | 9.4 | A | 800 |
| 12 | 320 | Reheating | 1050 | 25 | 850 | 3 | 650 | 1.3 | 3.0 | A | 800 |
| 13 | 320 | Reheating | 1050 | 25 | 850 | 3 | 650 | 1.3 | 2.7 | A | 800 |
| 14 | 320 | Reheating | 1050 | 25 | 850 | 3 | 650 | 1.3 | 3.0 | A | 800 |
| 16 | 320 | Reheating | 1150 | 25 | 880 | 3 | 650 | 1.3 | 2.2 | A | 800 |
| 17 | 320 | Reheating | 1200 | 25 | 900 | 3 | 700 | 1.4 | 3.9 | A | 800 |
| 18 | 320 | Reheating | 1200 | 25 | 900 | 3 | 700 | 1.4 | 4.2 | A | 800 |
| 19 | 320 | Reheating | 1000 | 25 | 830 | 3 | 620 | 0.9 | 1.5 | A | 800 |
| 20 | 320 | Reheating | 1000 | 25 | 800 | 3 | 650 | 0.8 | 1.7 | A | 800 |
| 21 | 320 | Reheating | 1000 | 25 | 770 | 3 | 600 | 0.9 | 1.8 | A | 800 |
| 22 | 320 | Reheating | 1000 | 25 | 750 | 3 | 550 | 0.8 | 2.0 | A | 800 |

TABLE 4-a2

| | Mechanical Characteristics | | | | | | | |
|---|---|---|---|---|---|---|---|---|
| Steel | YS (MPa) | TS (MPa) | E1 (%) | YE1 (%) | $\bar{r}$ value | AI (MPa) | TS × E1 (MPa %) | Note |
| 1 | 185 | 305 | 50 | 0.0 | 1.9 | 29 | 15250 | Applied Steel |
| 2 | 170 | 302 | 52 | 0.0 | 2.0 | 28 | 15704 | Applied Steel |
| 3 | 172 | 305 | 51 | 0.0 | 1.9 | 26 | 15555 | Applied Steel |
| 4 | 168 | 300 | 53 | 0.0 | 1.7 | 28 | 15900 | Applied Steel |
| 5 | 162 | 298 | 54 | 0.0 | 1.7 | 26 | 16092 | Applied Steel |
| 6 | 221 | 343 | 40 | 2.5 | 1.3 | 52 | 13720 | Steel of Comparison Example |
| 7 | 231 | 354 | 39 | 3.0 | 1.2 | 55 | 13806 | Steel of Comparison Example |
| 8 | 214 | 334 | 37 | 1.0 | 1.1 | 42 | 12358 | Steel of Comparison Example |
| 9 | 198 | 322 | 41 | 0.8 | 1.3 | 40 | 13202 | Steel of Comparison Example |
| 11 | 250 | 360 | 37 | 4.5 | 1.2 | 62 | 13320 | Steel of Comparison Example |
| 12 | 212 | 321 | 43 | 2.5 | 1.2 | 52 | 13803 | Steel of Comparison Example |
| 13 | 231 | 339 | 41 | 2.0 | 1.3 | 48 | 13899 | Steel of Comparison Example |
| 14 | 245 | 386 | 35 | 1.5 | 1.2 | 45 | 13510 | Steel of Comparison Example |
| 16 | 195 | 312 | 49 | 0.0 | 1.6 | 37 | 15288 | Applied Steel |
| 17 | 188 | 314 | 48 | 0.0 | 1.7 | 33 | 15072 | Applied Steel |
| 18 | 181 | 308 | 49 | 0.0 | 1.7 | 36 | 15092 | Applied Steel |
| 19 | 180 | 310 | 49 | 0.0 | 1.8 | 26 | 15190 | Applied Steel |
| 20 | 176 | 308 | 50 | 0.0 | 1.9 | 25 | 15400 | Applied Steel |
| 21 | 185 | 313 | 48 | 0.0 | 1.6 | 27 | 15024 | Applied Steel |
| 22 | 190 | 320 | 48 | 0.0 | 1.6 | 29 | 15360 | Applied Steel |

TABLE 4-b1

| | Slab | | | | Conditions of Hot Rolling | | | | Shape | Continuous Annealing | |
|---|---|---|---|---|---|---|---|---|---|---|---|
| Steel | Thickness (mm) | Reheating Method | Reheating Temperature (° C.) | Thickness of Sheet Bar (mm) | Finishing Delivery Temperature (° C.) | Thickness of Hot Rolled Steel Sheet (mm) | Coiling Temperature (° C.) | Cooling Velocity (° C./min) | Parameter S | Cycle | Temperature (° C.) |
| 23 | 320 | Reheating | 1000 | 25 | 800 | 3 | 650 | 0.8 | 1.5 | A | 800 |
| 24 | 320 | Reheating | 1000 | 25 | 800 | 3 | 650 | 1 | 1.3 | A | 800 |
| 25 | 320 | Reheating | 1000 | 25 | 820 | 3 | 650 | 0.8 | 2.6 | A | 800 |
| 26 | 320 | Reheating | 1050 | 25 | 820 | 3 | 700 | 1 | 3.1 | A | 800 |
| 27 | 320 | Reheating | 1050 | 25 | 820 | 3 | 700 | 1.3 | 4.2 | A | 800 |
| 28 | 320 | Reheating | 1050 | 25 | 820 | 3 | 650 | 1.8 | 7.2 | A | 800 |
| 29 | 320 | Reheating | 1050 | 25 | 870 | 3 | 650 | 1.2 | 5.4 | A | 800 |
| 30 | 320 | Reheating | 1050 | 25 | 870 | 3 | 650 | 1.6 | 6.7 | A | 800 |
| 31 | 320 | Reheating | 1050 | 25 | 870 | 3 | 650 | 1.5 | 9.4 | A | 800 |
| 32 | 320 | Reheating | 1050 | 25 | 870 | 3 | 650 | 1.6 | 6.5 | A | 800 |
| 33 | 320 | Reheating | 1050 | 25 | 870 | 3 | 650 | 1.3 | 12.3 | A | 800 |
| 34 | 320 | Reheating | 1050 | 25 | 870 | 3 | 600 | 1.6 | 13.4 | A | 800 |
| 35 | 320 | Reheating | 1050 | 25 | 870 | 3 | 600 | 1.5 | 10.4 | A | 800 |
| 36 | 320 | Reheating | 1050 | 25 | 870 | 3 | 600 | 1.8 | 9.8 | A | 800 |
| 37 | 320 | Reheating | 1050 | 25 | 840 | 3 | 600 | 1.5 | 3.2 | A | 800 |
| 38 | 320 | Reheating | 1050 | 25 | 840 | 3 | 600 | 1 | 2.7 | A | 800 |
| 41 | 320 | Reheating | 1000 | 25 | 840 | 3 | 600 | 1 | 1.7 | A | 800 |
| 42 | 320 | Reheating | 1000 | 25 | 820 | 3 | 620 | 0.8 | 2.1 | A | 800 |
| 43 | 320 | Reheating | 1000 | 25 | 800 | 3 | 650 | 0.7 | 1.8 | A | 800 |
| 44 | 320 | Reheating | 1000 | 25 | 770 | 3 | 600 | 0.9 | 1.1 | A | 800 |
| 45 | 320 | Reheating | 1050 | 25 | 870 | 3 | 650 | 1 | 6.7 | A | 800 |
| 46 | 320 | Reheating | 1050 | 25 | 870 | 3 | 650 | 1.2 | 5.9 | A | 800 |
| 47 | 320 | Reheating | 1050 | 25 | 870 | 3 | 650 | 0.7 | 7.7 | A | 800 |
| 48 | 320 | Reheating | 1050 | 25 | 870 | 3 | 650 | 0.9 | 6 | A | 800 |

TABLE 4-b2

| | Mechanical Characteristics | | | | | | | |
|---|---|---|---|---|---|---|---|---|
| Steel | YS (MPa) | TS (MPa) | E1 (%) | YE1 (%) | $\bar{r}$ value | AI (MPa) | TS × E1 (MPa %) | Note |
| 23 | 178 | 302 | 50 | 0 | 1.8 | 28 | 15100 | Applied Steel |
| 24 | 169 | 298 | 51 | 0 | 1.8 | 27 | 15198 | Applied Steel |
| 25 | 189 | 303 | 52 | 0 | 2 | 26 | 15756 | Applied Steel |
| 26 | 178 | 305 | 52 | 0 | 1.9 | 26 | 15860 | Applied Steel |
| 27 | 167 | 295 | 53 | 0 | 2 | 23 | 15635 | Applied Steel |
| 28 | 232 | 341 | 39 | 3 | 1.2 | 55 | 13299 | Steel of Comparison Example |
| 29 | 228 | 347 | 38 | 3.5 | 1.1 | 58 | 13186 | Steel of Comparison Example |
| 30 | 226 | 334 | 40 | 1.5 | 1.3 | 45 | 13360 | Steel of Comparison Example |
| 31 | 234 | 324 | 42 | 1 | 1.3 | 43 | 13608 | Steel of Comparison Example |
| 32 | 236 | 346 | 38 | 4 | 1.2 | 60 | 13148 | Steel of Comparison Example |
| 33 | 247 | 354 | 36 | 4.2 | 1.1 | 62 | 12744 | Steel of Comparison Example |
| 34 | 219 | 328 | 42 | 1 | 1.3 | 43 | 13776 | Steel of Comparison Example |
| 35 | 227 | 351 | 38 | 3.5 | 1.2 | 59 | 13338 | Steel of Comparison Example |
| 36 | 241 | 356 | 37 | 3.7 | 1.1 | 60 | 13172 | Steel of Comparison Example |
| 37 | 187 | 313 | 48 | 0 | 1.7 | 28 | 15024 | Applied Steel |
| 38 | 178 | 310 | 49 | 0 | 1.8 | 27 | 15190 | Applied Steel |
| 41 | 166 | 300 | 51 | 0 | 2 | 25 | 15300 | Applied Steel |
| 42 | 172 | 307 | 49 | 0 | 1.9 | 26 | 15043 | Applied Steel |
| 43 | 169 | 302 | 50 | 0 | 1.8 | 23 | 15100 | Applied Steel |
| 44 | 176 | 309 | 49 | 0 | 1.7 | 25 | 15141 | Applied Steel |
| 45 | 205 | 329 | 43 | 1 | 1.4 | 4T | 14147 | Steel of Comparison |

TABLE 4-b2-continued

| Steel | Mechanical Characteristics YS (MPa) | TS (MPa) | El (%) | YEl (%) | $\bar{r}$ value | AI (MPa) | TS × El (MPa %) | Note |
|---|---|---|---|---|---|---|---|---|
| 46 | 210 | 332 | 42 | 1.5 | 1.4 | 43 | 13944 | Example Steel of Comparison Example |
| 47 | 220 | 335 | 41 | 2 | 1.3 | 45 | 13735 | Steel of Comparison Example |
| 48 | 206 | 328 | 43 | 1 | 1.4 | 42 | 14104 | Steel of Comparison Example |

TABLE 4-c1

| Steel | Slab Thickness (mm) | Reheating Method | Reheating Temperature (° C.) | Rough Hot Rolling Temperature (° C.) | Thickness of Sheet Bar (mm) | Conditions of Hot Rolling Finishing Delivery Temperature (° C.) | Thickness of Hot Rolled Steel Sheet (mm) | Coiling Temperature (° C.) | Cooling Velocity (° C./min) | Shape Parameter S | Continuous Annealing Cycle | Temperature (° C.) |
|---|---|---|---|---|---|---|---|---|---|---|---|---|
| 49 | 300 | Reheating | 1050 | 850 | 30 | 750 | 3.5 | 550 | 1.1 | 3.0 | B | 750 |
| 50 | 300 | Rebeating | 980 | 890 | 30 | 750 | 3.5 | 650 | 1.3 | 6.7 | B | 750 |
| 51 | 300 | Reheating | 1030 | 880 | 30 | 750 | 3.5 | 650 | 1.3 | 5.8 | B | 750 |
| 52 | 300 | Reheating | 1050 | 930 | 30 | 800 | 3.5 | 600 | 1.2 | 8.3 | B | 750 |
| 53 | 300 | Keening | 1050 | 900 | 30 | 820 | 3.5 | 650 | 1.3 | 3.0 | B | 750 |
| 54 | 300 | Keeping | 1000 | 930 | 30 | 800 | 3.5 | 600 | 0.9 | 2.5 | B | 750 |
| 55 | 300 | Keeping | 1050 | 950 | 30 | 800 | 3.5 | 630 | 1.2 | 1.1 | B | 750 |

TABLE 4-c2

| Steel | Mechanical Characteristics YS (MPa) | TS (MPa) | El (%) | YEl (%) | $\bar{r}$ value | AI (MPa) | TS × El (MPa %) | Note |
|---|---|---|---|---|---|---|---|---|
| 49 | 205 | 325 | 45 | 0 | 1.6 | 31 | 14625 | Applied Steel |
| 50 | 251 | 363 | 35 | 0 | 1 3 | 32 | 12705 | Steel of Comparison Example |
| 51 | 268 | 338 | 32 | 0 | 1.2 | 32 | 10816 | Steel of Comparison Example |
| 52 | 277 | 354 | 30 | 4.2 | 1.1 | 62 | 10620 | Steel of Comparison Example |
| 53 | 180 | 309 | 46 | 0 | 1.6 | 25 | 14214 | Applied Steel |
| 54 | 195 | 320 | 45 | 0 | I.5 | 33 | 14400 | Applied Steel |
| 55 | 190 | 315 | 46 | 0 | 1.6 | 28 | 14490 | Applied Steel |

In the cementite of the hot rolled steel sheet, the cross section parallel to the rolling direction of the hot rolled steel sheet was observed by the SEM of 1000× magnification. The image analysis system device was used so as to measure the long side and the short side of the precipitate. The equation (1) heretofore defined was used to calculate the shape parameter S.

As a result, in the cold rolled steel sheet starting from the hot rolled steel strip having a chemical composition and the cementite shape in the range of the present invention, El≧45%, A.I.≦40 MPa and an $\bar{r}$ value≧about 1.5 was achieved. It was found that the steel sheet had excellent workability and excellent anti-aging properties.

EXAMPLE 2

The steel slab was composed of various steel compositions shown in Table 5, and its thickness was 250 mm. The steel slab was cast by continuous casting. In the cooling process, the slab was cooled at an interval of 1400 to 1100° C. by water cooling at various cooling velocities in the average cooling temperature of 8 to 200° C./min. At this time, the temperature of the slab was measured using a radiation thermometer. Thereafter, the slab was guided to a soaking pit so as to reheat the slab up to 900 to 1080°. In 3-pass rough hot rolling, the temperature and the reduction ratio were varied in the final pass. A sheet bar 30 mm thick was formed. In a 7-stand finishing roll mill, hot rolling was performed so that the finishing delivery temperature ranged from 750 to 820° C. and the finishing sheet thickness was 3.5 mm. Coiling was performed at a temperature of 700° C. or less. After pickling, cold rolling was performed so as to form a cold rolled steel sheet of 0.8 mm thickness. Thereafter, under the conditions shown in Table 6, recrystallization annealing was performed. Temper rolling was performed at a reduction ratio of 0.8%. The mechanical characteristics of the resulting steel sheet were investigated, and are shown in Table 7. A steel sheet satisfying the steel composition and manufacturing conditions of the present invention had both excellent workability and excellent anti-aging properties.

TABLE 5

(wt %)

| Steel | C | Si | Mn | P | S | Al | N | O | B | Ti | Nb | Cr | Si + Al | B/N | Ti/(1.5 S + 3.4 N) | Note |
|---|---|---|---|---|---|---|---|---|---|---|---|---|---|---|---|---|
| 56 | 0.022 | 0.003 | 0.08 | 0.011 | 0.007 | 0.006 | 0.0034 | 0.005 | 0.0044 | 0.005 | — | 0.50 | 0.009 | 1.3 | 0.23 | Applied Steel |
| 57 | 0.047 | 0.004 | 0.09 | 0.007 | 0.013 | 0.008 | 0.0026 | 0.004 | 0.0036 | 0.061 | 0.002 | — | 0.012 | 1.4 | 2.15 | Steel of Comparison Example |
| 58 | 0.036 | 0.017 | 0.04 | 0.012 | 0.004 | 0.012 | 0.0028 | 0.001 | 0.0015 | — | — | — | 0.029 | 0.5 | — | Steel of Comparison Example |
| 59 | 0.041 | 0.043 | 0.31 | 0.016 | 0.006 | 0.008 | 0.0021 | 0.004 | 0.0086 | — | — | 0.04 | 0.051 | 4.1 | — | Steel of Comparison Example |
| 60 | 0.028 | 0.028 | 0.42 | 0.005 | 0.014 | 0.004 | 0.0022 | 0.003 | 0.0019 | 0.004 | — | — | 0.032 | 0.9 | 0.14 | Applied Steel |
| 61 | 0.018 | 0.002 | 0.19 | 0.009 | 0.007 | 0.002 | 0.0026 | 0.011 | 0.0010 | — | — | — | 0.004 | 0.4 | — | Steel of Comparison Example |
| 62 | 0.033 | 0.027 | 0.14 | 0.007 | 0.009 | 0.036 | 0.0025 | 0.003 | — | — | — | — | 0.063 | — | — | Steel of Comparison Example |
| 63 | 0.016 | 0.031 | 0.08 | 0.008 | 0.007 | 0.008 | 0.0022 | 0.005 | 0.0041 | 0.007 | 0.003 | — | 0.039 | 1.9 | 0.39 | Applied Steel |
| 64 | 0.033 | 0.017 | 0.09 | 0.007 | 0.008 | 0.006 | 0.0020 | 0.004 | 0.0044 | 0.009 | — | — | 0.023 | 2.2 | 0.48 | Applied Steel |
| 65 | 0.041 | 0.023 | 0.14 | 0.009 | 0.007 | 0.005 | 0.0017 | 0.005 | 0.0035 | 0.007 | — | — | 0.028 | 2.1 | 0.43 | Applied Steel |
| 66 | 0.035 | 0.010 | 0.11 | 0.008 | 0.006 | 0.004 | 0.0019 | 0.003 | 0.0036 | 0.008 | — | — | 0.014 | 1.9 | 0.52 | Applied Steel |

TABLE 6

| | Slab | Slab Reheating | | Rough Hot Rolling Final Pass | | | Finishing Delivery | Coiling | | Shape | Continuous Annealing | | |
|---|---|---|---|---|---|---|---|---|---|---|---|---|---|
| Steel | Cooling Velocity* (° C./min) | Method | Temperature (° C.) | Temperature T (° C.) | Reduction Ratio R (%) | R/T | Temperature (° C.) | Temperature (° C.) | Cooling Velocity (° C./min) | Parameter S | Cycle | Temperature (° C.) | Note |
| 56(A) | 90 | Reheating | 1010 | 900 | 27 | 0.03 | 750 | 630 | 1.2 | 2.7 | B | 800 | Applied Steel |
| 57 | 15 | Reheating | 1030 | 930 | 25 | 0.03 | 800 | 580 | 0.9 | 1.6 | B | 800 | Steel of Comparison Example |
| 58 | 20 | Reheating | 1040 | 920 | 35 | 0.04 | 790 | 620 | 1.1 | 3.3 | B | 800 | Steel of Comparison Example |
| 59 | 25 | Keeping | 1010 | 860 | 55 | 0.06 | 810 | 650 | 1.3 | 2.8 | B | 800 | Steel of Comparison Example |
| 60(A) | 15 | Reheating | 970 | 900 | 40 | 0.04 | 750 | 640 | 1.3 | 1.9 | B | 800 | Appled Steel |
| 61 | 17 | Reheating | 1000 | 880 | 40 | 0.05 | 780 | 650 | 0.9 | 3.0 | B | 800 | Steel of Comparison Example |
| 62 | 40 | Reheating | 1050 | 870 | 35 | 0.04 | 820 | 660 | 1.4 | 4.0 | B | 800 | Steel of Comparison Example |
| 56(B) | 20 | Keeping | 1090 | 1000 | 10 | 0.01 | 770 | 650 | 1.3 | 2.6 | B | 800 | Steel of Comparison Example |
| 60(B) | 30 | Reheating | 1040 | 810 | 75 | 0.09 | 700 | 580 | 0.9 | 3.4 | B | 800 | Steel of Comparison Example |
| 63 | 115 | Reheating | 1060 | 900 | 35 | 0.04 | 760 | 600 | 1.0 | 8.3 | B | 800 | Steel of Comparison Example |
| 64 | 15 | Keeping | 1000 | 870 | 40 | 0.05 | 800 | 650 | 1.3 | 3.0 | B | 800 | Applied Steel |
| 65 | 35 | Reheating | 1030 | 900 | 30 | 0.03 | 820 | 600 | 1.0 | 2.5 | B | 800 | Applied Steel |
| 66 | 8 | Reheating | 1050 | 870 | 25 | 0.03 | 800 | 620 | 0.9 | 7.0 | B | 800 | Steel of Comparison Example |

*Average Cooling Velocity 1400→1100° C.

TABLE 7

| Steel | Oxide, Sulfide, Nitride Average Grain Diameter (μm) | Average Distance (μm) | YS (MPa) | TS (MPa) | E1 (%) | YE1 (%) | AI (MPa) | r̄ 値 | TS × E1 (MPa %) | Note |
|---|---|---|---|---|---|---|---|---|---|---|
| 56(A) | 0.078 | 1.3 | 201 | 315 | 45 | 0 | 28 | 1.6 | 14175 | Applied Steel |
| 57 | 0.621 | 5.8 | 224 | 326 | 40 | 1.5 | 41 | 1.4 | 13040 | Steel of Comparison Example |
| 58 | 0.009 | 5.2 | 210 | 324 | 38 | 3.1 | 48 | 1.2 | 12312 | Steel of Comparison Example |
| 59 | 0.240 | 2.1 | 234 | 332 | 37 | 1.5 | 55 | 1.1 | 12284 | Steel of Comparison Example |
| 60(A) | 0.320 | 4.0 | 189 | 334 | 46 | 0 | 31 | 1.7 | 15364 | Applied Steel |
| 61 | 0.093 | 5.5 | 209 | 320 | 41 | 4.2 | 39 | 1.4 | 13120 | Steel of Comparison Example |
| 62 | 0.210 | 2.3 | 223 | 324 | 37 | 4.6 | 58 | 1.2 | 11988 | Steel of Comparison Example |
| 56(B) | 0.110 | 1.5 | 216 | 315 | 38 | 3.2 | 41 | 1.3 | 11970 | Steel of Comparison Example |
| 60(B) | 0.283 | 3.3 | 203 | 321 | 40 | 2.2 | 45 | 1.1 | 12840 | Steel of Comparison Example |
| 63 | 0.007 | 0.4 | 211 | 326 | 40 | 1 | 44 | 1.3 | 13040 | Steel of Comparison Example |
| 64 | 0.300 | 4.1 | 187 | 315 | 46 | 0 | 30 | 1.6 | 14490 | Applied Steel |
| 65 | 0.240 | 2.5 | 193 | 320 | 45 | 0 | 33 | 1.5 | 14400 | Applied Steel |
| 66 | 0.196 | 6.0 | 211 | 326 | 40 | 0.5 | 41 | 1.4 | 13040 | Steel of Comparison Example |

EXAMPLE 3

The slab was composed of the steel composition shown in Table 8, and its thickness was 300 mm. As shown in Table 9, the slab was reheated up to 900 to 1250° C. In 3-pass rough hot rolling, the temperature and reduction ratio were then varied in the final pass. A sheet bar 30 mm thick was formed. In the 7-stand finishing roll mill, hot rolling was performed so that the finishing delivery temperature ranged from 700 to 900° C. and the finishing sheet thickness was 3.5 mm. Coiling was performed at 700° C. or less. After pickling, cold rolling was performed so as to form cold rolled steel sheet 0.8 mm in thickness. Thereafter, under the conditions shown in Table 9, recrystallization annealing was performed. Temper rolling was performed at a reduction ratio of 0.8%. The mechanical characteristics of the resulting steel sheet were investigated, and are shown in Table 10. Steel sheet satisfying the composition and manufacturing conditions of the present invention showed good workability and anti-aging properties.

TABLE 8

(wt %)

| Steel | C | Si | Mn | P | S | Al | N | B | Ti | Nb | Cr | B/N | Ti/(1.5 S + 3.4 N) | Note |
|---|---|---|---|---|---|---|---|---|---|---|---|---|---|---|
| 67 | 0.032 | 0.03 | 0.09 | 0.007 | 0.009 | 0.005 | 0.0026 | 0.0031 | 0.005 | — | — | 1.2 | 0.22 | Applied Steel |
| 68 | 0.022 | 0.02 | 0.07 | 0.007 | 0.007 | 0.004 | 0 0033 | 0.0035 | 0.005 | — | 0.68 | 1.1 | 0.23 | Applied Steel |
| 69 | 0.021 | 0.01 | 0.45 | 0.008 | 0.014 | 0.043 | 0.0032 | 0.0036 | 0.018 | 0.048 | — | 1.1 | 0.56 | Steel of Comparison Example |
| 70 | 0.018 | 0.02 | 0.42 | 0.009 | 0.017 | 0.044 | 0.0126 | 0.0028 | — | — | — | 0.2 | — | Steel of Comparison Example |
| 71 | 0.028 | 0.01 | 0.18 | 0.004 | 0.011 | 0.026 | 0.0028 | — | — | — | — | — | — | Steel of Comparison Example |
| 72 | 0.016 | 0.02 | 0.09 | 0.009 | 0.008 | 0.005 | 0.0023 | 0.0037 | 0.004 | 0.002 | 0.09 | 1.6 | 0.20 | Applied Steel |
| 73 | 0.035 | 0.01 | 0.13 | 0.012 | 0.009 | 0.008 | 0.0026 | 0.0039 | 0.006 | — | — | 1.5 | 0.27 | Applied Steel |
| 74 | 0.022 | 0.01 | 0.1 | 0.008 | 0.01 | 0.006 | 0.0021 | 0.0033 | 0.007 | — | — | 1.6 | 0.32 | Applied Steel |

TABLE 10

| Steel | YS (MPa) | TS (MPa) | E1 (%) | YE1 (%) | AI (MPa) | $\bar{r}$ value | Presence or Absence of Ridging | Note |
|---|---|---|---|---|---|---|---|---|
| 67 | 202 | 314 | 45 | 0 | 32 | 1.6 | Absent | Applied Steel |
| 68(A) | 192 | 321 | 48 | 0 | 28 | 1.8 | Absent | Anplied Steel |
| 68(B) | 205 | 336 | 45 | 1.5 | 38 | 1.4 | Present | Steel of Comparison Example |
| 69 | 210 | 314 | 41 | 2.3 | 51 | 1.2 | Absent | Steel of Comparison Example |
| 70 | 256 | 338 | 38 | 5.5 | 62 | 1.1 | Absent | Steel of Comparison Example |
| 71 | 246 | 327 | 40 | 5.2 | 58 | 1.1 | Absent | Steel of Comparison Example |
| 72 | 194 | 321 | 47 | 0 | 28 | 1.7 | Absent | Applied Steel |
| 73 | 195 | 327 | 46 | 0 | 31 | 1.5 | Absent | Applied Steel |
| 74 | 193 | 320 | 47 | 0 | 30 | 1.6 | Absent | Applied Steel |

In the description of the present invention, as regards the measurement of the distribution of non-metallic inclusions, three kinds of non-metallic inclusions, (the oxide, the sulfide and the nitride) are exemplified for convenience. In fact, besides those three kinds of non-metallic inclusions, oxy-acid nitride, oxy-acid sulfide, carbo-nitride, or the like can be present in the steel. Therefore, these composite non-metallic inclusions are also an object of the measurement.

The cold rolled steel sheet manufactured by the present invention has excellent mechanical characteristics such as deep drawability and anti-aging properties. In addition, since the material is a low carbon killed steel the cold rolled steel sheet of the present invention has much better characteristics (such as chemical conversion treatability and welding strength,) as compared to an ultra low carbon killed steel. The material itself is inexpensive, and operability is very good in continuous annealing facilities. The line velocity is easily increased. Mass production is effective and manufacturing cost is significantly reduced.

What is claimed is:

1. A cold rolled steel sheet comprising about:

C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more and

Ti(wt %)/[1.5×S(wt %)+3.4×N(wt %)]≦about 1.0; and

B: about 0.0001 to 0.0050 wt %;

and the balance substantially iron with incidental impurities, said cold rolled steel sheet having a tensile strength not greater than about 327 MPa.

2. A hot rolled steel strip for use in manufacturing of a cold rolled steel sheet of claim 1 comprising about:

C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more and

Ti(wt %)/[1.5×S(wt %)+3.4×N(wt %)]≦about 1.0; and

B: about 0.0001 to.0050 wt %;

said steel strip having a cross-sectional microstructure comprising cementite and pearlite, wherein the shape of said cementite, except the cementite in said pearlite, satisfies a shape parameter S of about 1.0 to 5.0 obtained by the following equation (1):

$$S = (1/n)\sum_{i=1}^{n}(Lli/Lsi); \quad (1)$$

where

Lli represents the length of a long side of the ith cementite (μm) and

Lsi represents the length of a short side of the ith cementite (μm).

3. A method of manufacturing a cold rolled steel sheet, which comprises providing a steel slab comprising about:

C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more and

Ti(wt %)/[1.5×S(wt %)+3.4×N(wt %)]≦about 1.0; and

B: about 0.0001 to 0.0050 wt %, said method comprising the steps of:

(a) reheating or keeping said steel slab to a temperature of about 1100° C. or less;

(b) in a hot rolling process including a rough hot rolling step having a final pass and a finishing hot rolling step, said rough hot rolling of said steel slab being conducted in such a manner that the relationship between temperature T(°C.) and reduction ratio R(%) in said final pass of said rough hot rolling step satisfies the following condition;

$$0.02 \leqq R/T \leqq \text{about } 0.08,$$

and hot rolling said steel slab in said finishing hot rolling step to make a hot rolled steel sheet;

(c) coiling the resulting hot rolled steel sheet;

(d) spheroidizing a cementite phase in said hot rolled steel sheet;

(e) cold rolling; and (f) in a continuous annealing process, keeping the obtained steel sheet for about five minutes or less in the range of recrystallization temperature to about 850° C., cooling the resulting steel sheet and causing said steel sheet to reside for about 5 to about 120 seconds at a temperature of about 500 to 300° C.

4. The cold rolled steel sheet according to claim 1, further comprising Nb, wherein the total amount of Nb content and said Ti content ranges from about 0.001 to 0.050 wt %.

5. The cold rolled steel sheet according to claim 4, further comprising about 0.05 to 1.00 wt % of Cr.

6. The cold rolled steel sheet according to any of claims 1, 4 and 5, further comprising about:

O: 0.002 to 0.010 wt %;

Si and Al, in which the sum of Si content and Al content is about 0.005 wt % or more; and a non-metallic inclusion, wherein said non-metallic inclusion is composed of at least one oxide, sulfide or nitride in which the average diameter of said inclusion ranges from about 0.01 to 0.50 $\mu$m and the average distance ranges from about 0.5 to 5.0 $\mu$m.

7. The method according to claim 3, wherein said steel slab composition further comprises Nb in which the total amount of Nb and Ti is about 0.001 to 0.050 wt %.

8. The method according to claim 7, wherein said steel slab composition further comprises about 0.05 to 1.00 wt % of Cr.

9. The method according of claim 3, wherein said steel slab is cast by continuous casting, said cast steel slab is cooled between about 1400 to 1100° C. at an average cooling velocity of about 10 to 100° C./min in the cooling step, and hot rolling is then performed.

10. A method of manufacturing the hot rolled steel sheet of claim 2, in which said steel slab comprises about C: above 0.015 to 0.150 wt %;

Si: 1.0 wt % or less;

Mn: 0.01 to 1.50 wt %;

P: 0.10 wt % or less;

S: 0.003 to 0.050 wt %;

Al: 0.001 to below 0.010 wt %;

N: 0.0001 to 0.0050 wt %;

Ti: 0.001 wt % or more and

Ti(wt %)/[1.5×S(wt %)+3.4×N(wt %)]≦about 1.0; and

B: about 0.0001 to 0.0050 wt %, said method comprising the steps of:

(a) reheating or keeping said steel slab to a temperature of about 1100° C. or less; and (b) in a hot rolling process including a rough hot rolling step having a final pass and a finishing hot rolling step, rough hot rolling said steel slab in such a manner that the relationship between temperature T(°C.) and reduction ratio R(%) in said final pass satisfies the following condition:

$$0.02 \leqq R/T \leqq \text{about } 0.08,$$

and hot rolling said steel slab at about 850° C. or less in said finishing hot rolling step.

11. The method according to claim 3, wherein said spheroidizing comprises cooling from a temperature at which said coiling occurs at a rate of about 1.5° C. per minute or less.

12. The method according to claim 3, wherein said reheating is to a temperature in a range of about 1000° C. to about 1100° C.

13. The method according to claim 3, wherein said coiling is carried out in a temperature range of about 550° C. to about 750° C.

14. The method of claim 3, wherein said cold rolling comprises a reduction ratio of at least about 40 percent.

15. The cold rolled steel sheet of claim 1, wherein said Mn is no more than about 0.50 wt %.

16. The cold rolled steel sheet of claim 1, further comprising a percent elongation of at least about 45.

17. The cold rolled steel sheet of claim 1, further comprising an aging index (A.I.) of not more than about 40 MPa.

18. The cold rolled steel sheet of claim 1, further comprising an r value of at least 1.5.

19. The cold rolled steel sheet of claim 1, produced by the method of claim 3.

20. The cold rolled steel sheet of claim 1, wherein said hot rolled steel sheet comprises a cementite phase and a pearlite phase, and further as a result of said spheroidizing, said cementite, except the cementite in pearlite, satisfies a shape parameter S of about 1.0 to 5.0 obtained by the following equation (1):

$$S = (1/n)\sum_{i=1}^{n}(Lli/Lsi); \quad (1)$$

where

Lli represents the length of a long side of the ith cementite ($\mu$m) and

Lsi represents the length of a short side of the ith cementite ($\mu$m).

* * * * *

UNITED STATES PATENT AND TRADEMARK OFFICE

CERTIFICATE OF CORRECTION

PATENT NO. : 6,027,581
DATED : February 22, 2000
INVENTOR(S) : Osawa et al.

It is certified that error appears in the above-identified patent and that said Letters Patent is hereby corrected as shown below:

Column 5,
Table 1, at the subheading "P", at "Steel G", please change "0.014" to -- 0.011 --.

Column 19,
Table 4-b2, at the subheading "AI(MPa)", at "Steel 45", please change "4T" to -- 41 --.

Column 25,
After Table 8, please insert the following Table 9:

Table 9

| Steel | Slab Reheating Method | Slab Reheating Temperature (℃) | Rough Hot Rolling Final Pass Temperature T (℃) | Rough Hot Rolling Final Pass Reduction Ratio R % | Rough Hot Rolling Final Pass R/T | Finishing Delivery Temperature (℃) | Coiling Temperature (℃) | Continuous Annealing Cycle | Continuous Annealing Temperature (℃) | Note |
|---|---|---|---|---|---|---|---|---|---|---|
| 67 | Reheating | 1020 | 900 | 40 | 0.044 | 790 | 650 | B | 800 | Applied Steel |
| 68 (A) | Keeping | 1030 | 900 | 41 | 0.046 | 780 | 590 | B | 800 | Applied Steel |
| 68 (B) | Reheating | 1060 | 910 | 13 | 0.014 | 770 | 500 | B | 800 | Steel of Comparison Example |
| 69 | Keeping | 1030 | 900 | 38 | 0.042 | 800 | 620 | B | 800 | Steel of Comparison Example |
| 70 | Reheating | 1050 | 880 | 45 | 0.050 | 720 | 650 | B | 800 | Steel of Comparison Example |
| 71 | Reheating | 1030 | 870 | 60 | 0.069 | 740 | 640 | B | 800 | Steel of Comparison Example |
| 72 | Reheating | 1080 | 910 | 39 | 0.043 | 800 | 660 | B | 800 | Applied Steel |
| 73 | Keeping | 1000 | 910 | 19 | 0.021 | 790 | 640 | B | 800 | Applied Steel |
| 74 | Reheating | 1030 | 900 | 33 | 0.037 | 770 | 650 | B | 800 | Applied Steel |

Column 27,
Table 10, at the subheading "Note", at "Steel 68(A)", please change "Anplied" to -- Applied --.

Column 29, claim 10,
Line 2, please change "claim 2" to -- claim 3 --.

Column 30, claim 20,
Line 1, please change "claim 1" to -- claim 19 --.

Signed and Sealed this

Eighth Day of January, 2002

*Attest:*

*Attesting Officer*

JAMES E. ROGAN
*Director of the United States Patent and Trademark Office*